US010077657B2

(12) United States Patent
He et al.

(10) Patent No.: US 10,077,657 B2
(45) Date of Patent: Sep. 18, 2018

(54) COMPOUND-TYPE TUNNELING SHIELD

(71) Applicant: China Railway Engineering Equipment Group Co., Ltd., Zhengzhou, Henan Province (CN)

(72) Inventors: Yulian He, Zhengzhou (CN); Jianbin Li, Zhengzhou (CN)

( * ) Notice: Subject to any disclaimer, the term of this patent is extended or adjusted under 35 U.S.C. 154(b) by 342 days.

(21) Appl. No.: 14/909,438

(22) PCT Filed: Aug. 6, 2014

(86) PCT No.: PCT/CN2014/083768

§ 371 (c)(1),
(2) Date: Feb. 1, 2016

(87) PCT Pub. No.: WO2015/014323

PCT Pub. Date: Feb. 5, 2015

(65) Prior Publication Data

US 2016/0194957 A1 Jul. 7, 2016

(30) Foreign Application Priority Data

Aug. 2, 2013 (CN) ..... 2013 1 0335547

(51) Int. Cl.

| | |
|---|---|
| ***E21D 9/08*** | (2006.01) |
| ***E21D 9/087*** | (2006.01) |
| ***E21D 9/06*** | (2006.01) |
| ***E21D 9/10*** | (2006.01) |
| ***E21D 9/11*** | (2006.01) |

(52) U.S. Cl.

CPC ..... *E21D 9/087* (2013.01); *E21D 9/06* (2013.01); *E21D 9/08* (2013.01); *E21D 9/0879* (2016.01); *E21D 9/1006* (2013.01); *E21D 9/1066* (2013.01); *E21D 9/112* (2013.01)

(58) Field of Classification Search

CPC .. E21D 9/11; E21D 9/112; E21D 9/10; E21D 9/1006; E21D 9/1066; E21D 9/087; E21D 9/08

USPC ..... 175/67; 299/16, 17, 31, 33, 55; 405/138, 141

See application file for complete search history.

(56) References Cited

FOREIGN PATENT DOCUMENTS

| | | | |
|---|---|---|---|
| JP | 1-169093 A | * | 7/1989 |
| JP | 6-257380 A | * | 9/1994 |
| JP | 2005-320851 A | * | 11/2005 |

OTHER PUBLICATIONS

Machine Translation of JP 1-169093, Jul. 1989, 2 pages.*
Machine Translation of JP 2005-320851, Nov. 2005, 10 pages.*
Machine Translation of JP 6-257380, Sep. 1994, 10 pages.*

* cited by examiner

*Primary Examiner* — Sunil Singh
(74) *Attorney, Agent, or Firm* — Novoclaims Patent Services LLC; Mei Lin Wong

(57) ABSTRACT

A tunnel boring apparatus includes a shield body and a cutting disc provided at a front portion of the shield body. The tunnel boring apparatus includes a high pressure liquid device, which includes a liquid storage tank for storing a predetermined amount of liquid, a pressure raising device for increasing a pressure of the liquid, and a plurality of nozzles. The pressing raising device is connected to the liquid storage tank, and to a central rotating head through a first guiding pipeline. The nozzles are provided on the cutting disc, and are connected to the central rotating head through a second guiding pipeline.

5 Claims, 7 Drawing Sheets

COMPOUND-TYPE TUNNELING SHIELD

BACKGROUND OF THE PRESENT INVENTION

Field of Invention

The present invention relates tunneling shield structure, and more particularly to a hybrid-type tunnel boring apparatus.

Description of Related Arts

A conventional tunnel boring apparatus is for excavating a tunnel. A hybrid-type tunnel boring apparatus is particularly suitable for excavating tunnel through unstable and mixed terrain consisting of clay, sandy soil, weathered rocks, and sandy gravel stratum. A conventional hybrid-type tunnel boring apparatus usually comprises a shield and a rotating cutting wheel. The shield usually has a front shield portion, a mid shield portion and a rear shield portion. The rotating cutting wheel is usually positioned at the forefront of the tunnel boring apparatus and arranged to be in contact with the stratum for excavating thereof. The rotating cutting wheel of the hybrid-type tunnel boring apparatus is usually equipped with a wide variety of cutting tools for excavating mixed ground. Thus, the rotating cutting wheel may comprise cutting bits and scrapers designed for soft ground tunneling, and disc cutters designed for hard ground tunneling. For this type of rotating wheel, when it is used to excavate soft ground, the disc cutter may have a friction which is less than a starting resistance of the disc cutter. When this is the case, the disc cutter may not be started properly. Moreover, when the disc cutter is used on soft terrain with liquid, the excavated material may reside on the disc cutter which may severely affect excavating performance or permanently damage the cutter head. This phenomenon increases the frequency of which the cutter head must be replaced, and prolongs the completion time of the overall excavation process.

SUMMARY OF THE PRESENT INVENTION

An objective of the present invention is to provide a hybrid type tunnel boring apparatus which may be used on soft ground and hard rock. Specifically, the hybrid type tunnel boring apparatus prevents the use of a conventional cutting tools by ejecting high pressure liquid for leaving cutting marks and pre-cut slots on the ground surface.

In one aspect of the present invention, it provides a tunnel boring apparatus, comprising a shield body and a cutting disc provided at a front portion of the shield body, the tunnel boring apparatus further comprises a high pressure liquid device, which comprises:

a liquid storage tank for storing a predetermined amount of liquid;

a pressure raising device for increasing a pressure of the liquid, the pressing raising device connecting to the liquid storage tank, and connecting to a central rotating head through a first guiding pipeline; and a plurality of nozzles provided on the cutting disc, the nozzles connecting to the central rotating head through a second guiding pipeline.

Preferably, each of the nozzles is provided on the cutting disc at a position between two adjacent cutters.

Preferably, the tunnel boring apparatus further comprises a protective cover, the protective cover covers the second guiding pipeline and a connecting portion between the nozzles and the second guiding pipeline.

Preferably, the pressure raising device further comprises a pressurized device, a control valve, and a pumping device connected to the liquid storage tank;

the control valve being connected to a liquid pump, the liquid pump being connected to the oil storage tank;

the pressurized device comprises a main piston which divides an internal space of a cylinder into a first piston chamber and a second piston chamber, a first piston column and a second piston column extended from two sides of the main piston into the first piston chamber and the second piston chamber respectively, the cylinder further having a first column chamber and a second column chamber extended from the first piston chamber and the second piston chamber respectively, wherein the first piston column is partially and movably and reciprocally received in the first column chamber, while the second piston column is partially and movably and reciprocally received in the second column chamber, the first piston column separating the first piston chamber and the first column chamber, the second piston column separating the second piston chamber and the second column chamber, the first piston chamber having a first passage opening, the second piston chamber having a second passage opening, the first column chamber having a third passage opening, the second column chamber having a fourth passage opening;

the pumping device being connected to the third passage opening through the first pumping pipeline, the first pumping pipeline being connected to a first unidirectional valve in series, in such a manner that the first unidirectional valve is configured to allow liquid to flow from the pumping device to the third passage opening only;

the pumping device being connected to the fourth passage opening through a second pumping pipeline, the second pumping pipeline being connected to a second unidirectional valve in series, in such a manner that the second unidirectional valve is configured to allow liquid to flow from the pumping device to the fourth passage opening only;

the third passage opening being connected to the first guiding pipeline through a third unidirectional valve, which is configured to allow liquid flowing from the third passage opening to the first guiding pipeline only;

the fourth passage opening being connected to the first guiding pipeline through a fourth unidirectional valve, which is configured to allow liquid flowing from the fourth passage opening to the first guiding pipeline only;

when the control valve is in a first operating position, the liquid pump is connected to the first passage opening, and the second passage opening is connected to an oil storage tank, when the control valve is switched to a second operating position, the liquid pump is connected to the second passage opening, the first passage opening is connected to the oil storage tank.

Preferably, the tunnel boring apparatus further comprises an energy storage device which is provided in the first guiding pipeline.

Preferably, the pressure raising device further comprises a plurality of pressurized devices connected in parallel and are connected to the first guiding pipeline.

Preferably, the pressure raising device comprises a driving unit, and a high pressure piston pump connected to the driving unit, an inlet of the high pressure piston pump being connected to the liquid storage tank, an outlet of the high pressure piston pump being connected to the first guiding pipeline.

Preferably, the tunnel boring apparatus further comprises a hybrid nozzle assembly which comprises a mixing chamber and a regulating opening communicated with the mixing chamber, the regulating opening communicating with the second guiding pipeline, a diameter of the regulating opening being smaller than that of an internal diameter of the mixing chamber; the grinder supplying device comprising a grinder storage tank connected to the mixing chamber of the hybrid nozzle assembly, the grinder storage tank having a ventilating hole communicating with ambient air.

Preferably, the tunnel boring apparatus further comprises a flow regulator replaceably provided between the mixing chamber and the grinder storage tank, and connected to a grinder connecting pipeline.

The present invention provides a tunnel boring apparatus, comprising a shield body and a cutting disc provided at a front portion of the shield body, the tunnel boring apparatus further comprises a high pressure liquid device, which comprises: a liquid storage tank for storing a predetermined amount of liquid; a pressure raising device for increasing a pressure of the liquid, the pressing raising device connecting to the liquid storage tank, and connecting to a central rotating head through a first guiding pipeline; and a plurality of nozzles provided on the cutting disc, the nozzles connecting to the central rotating head through a second guiding pipeline. The operation of the present invention is as follows: the liquid stored in the liquid storage tank is pressurized and delivered to the central rotating head through the first guiding pipeline. The high pressure liquid is then delivered to the nozzles through the second guiding pipeline. The liquid is then ejected to the ground surface. Since the nozzle array and the cutting disc are arranged to rotate simultaneously, the high pressure liquid will leave cutting marks or pre-cut slots on the ground surface which correspond to the distribution pattern of the nozzles formed on the cutting disc. Since the liquid is highly pressurized, when the liquid comes into contact with the ground surface which is to be excavated, the result is that the pressurized liquid will eventually form cutting slots on the ground surface which is to be excavated. These cutting slots cause stress concentration when the cutters of the cutting disc come into contact with the cutting slots. When the excavation process is being operated, the cutting slots serve as a means to allow the ground surface to be more easily bored and cut by the cutters formed on the cutting disc.

The present invention has wider applicability to different grounds types. When the present invention is used in soft ground, a user of the present invention may utilize both the cutters and the high pressure liquid for excavation. This prevents the cutting disc from being accidentally stuck. This also prevents excavated material from being abundantly residing on the cutting disc. When the present invention is used on hard rock, the high pressure liquid causes cutting marks on the ground surface. This allows the cutters of the present invention to easily cut the ground surface. Furthermore, conventional tools for excavating soft grounds such as cutting bits and scrapers may be utilized for excavating hard rock with the aid of the high pressure liquid and the formation of the cutting marks. These arrangements reduce the need to have hard rock cutting tools and the corresponding replacement time and costs and thus increases the overall efficiency of tunnel boring. Furthermore, the high pressure liquid may actually have cooling and cleaning effect to the cutters and the cutting disc so as to increase the general lifespan of the cutters and the cutting disc. In addition, ejecting liquid in tunnels may also help in removing dusts and decreasing temperature in the tunnels.

BRIEF DESCRIPTION OF THE DRAWINGS

In order to clearly describe the preferred embodiment of the present invention or its related arts, the following is a brief description of accompanying drawings. Obviously, the description which is provided below is the drawings illustrating the preferred embodiments of the present invention. On skill in the art may derive other drawings from the accompanying drawings without exercising additional inventive steps.

Figure 1:
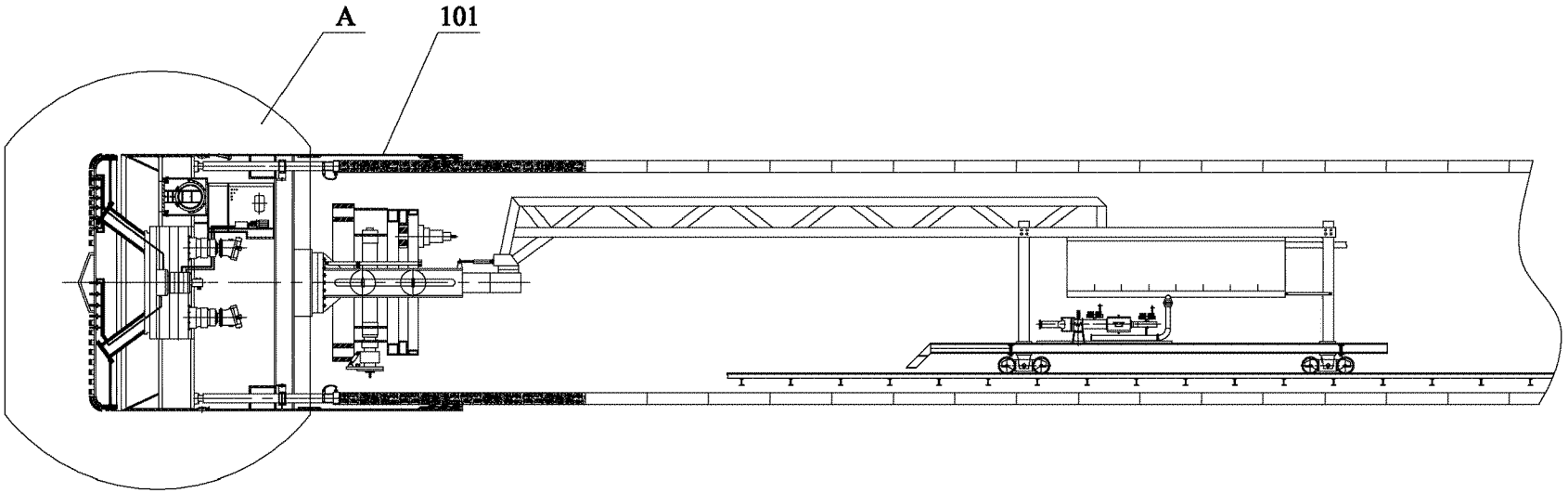
FIG. 1 is a schematic diagram of a hybrid tunnel boring apparatus according to a first preferred embodiment of the present invention, illustrating the structure of a high pressure liquid device.

In above FIG. 1 to FIG. 9:

shield body 101; cutter 102; cutting disc 103; liquid storage tank 1; pumping device 2; pressurized device 3; first guiding pipeline 4; central rotating head 5; second guiding pipeline 6; protective cover 7; nozzle 8; nozzle head 81; nozzle end portion 82; hole 83; piston 9; first piston column 91; second piston column 92; first pumping pipeline 21; second pumping pipeline 22; first unidirectional valve 23; second unidirectional valve 24; third unidirectional valve 25; fourth unidirectional valve 26; liquid pump 27; oil storage tank 28; first piston chamber 31; second piston chamber 32; first column chamber 33; second column chamber 34; first passage opening 35; second passage opening 36; third passage opening 37; fourth passage opening 38; control valve 10; energy storage device 11; driving unit 12; high pressure piston pump 13; hybrid nozzle assembly 14; mixing chamber 141; regulating opening 142; grinder storage tank 19; ventilating hole 191; lower portion 192; nut bolt 193; upper portion 194; flow regulator 195.

DETAILED DESCRIPTION OF THE PREFERRED EMBODIMENT

By referring to the detailed description of the preferred embodiments and the accompanying drawings, one may better understand the features and operation of the present invention. Moreover, the following detailed description of the preferred embodiments is the preferred modes of carrying out the invention. The description is not to be taken in any limiting sense. It is presented for the purpose of illustrating the general principles of the present invention. Each of the inventive features described below can be used independently of one another or in combination with other features.

It is worth mentioning that the terms "first" and "second" used in the following description merely signify differences in elements, but are not adopted to indicate sequence in time, or any proximal relationship between the relevant elements. Similarly, the terms "left" and "right" used in the following description indicate the relative position on the relevant drawings, while the terms "front" and "rear" used in the following description indicate the direction during the excavation process. The terms used for indicating relative position refer to the position relative to the hybrid tunnel boring apparatus of the present invention when it is being operated. When a first element is referred to be positioned above second element, it means that the second element is positioned directly above the first element, or the second element is positioned above the first element with certain intervening medium or they are separated by a predetermined distance. Similarly, when a first element is said to be connected to the second element, it means the first element is directly connected to the second element, or through certain intervening elements. For instances, when a grinder supplying device is said to be connected to a nozzle, it means that the grinder supplying device is directly connected to the nozzle, or the grinder supplying device is connected to the nozzle through a connecting pipeline.

Embodiment 1

Figure 2:
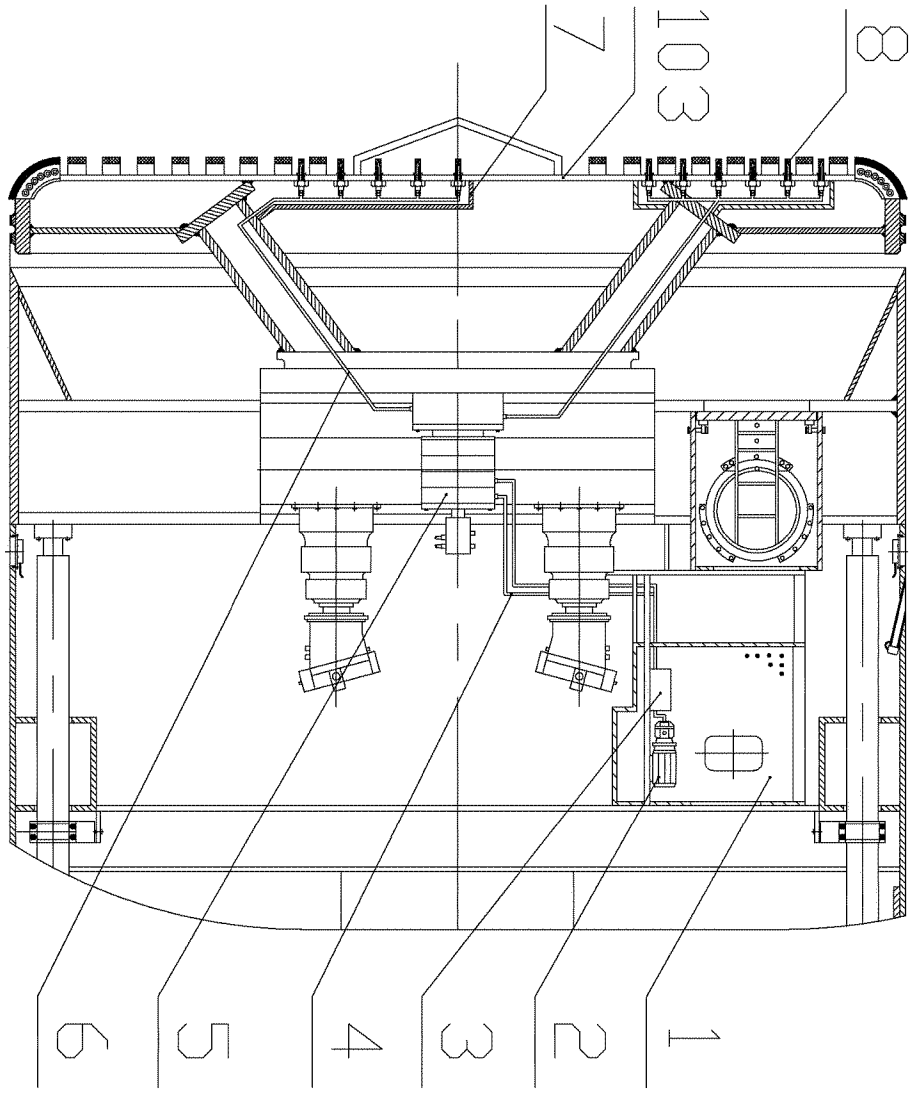
FIG. 2 is a zoom-in schematic diagram of Zone A of FIG. 1.
Figure 3:
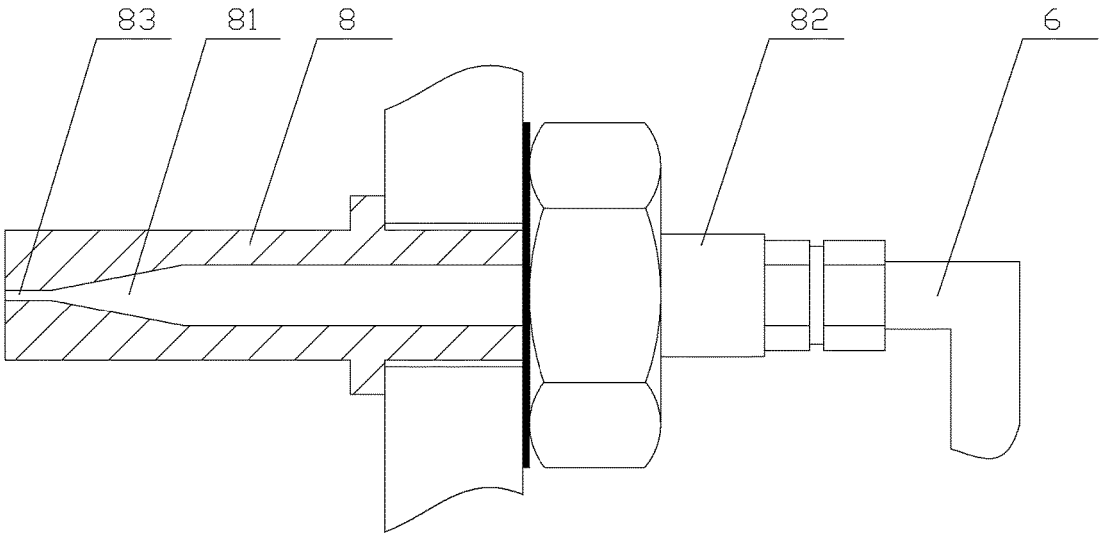
FIG. 3 is a schematic diagram of a nozzle according to the first preferred embodiment of the present invention.
Figure 4:
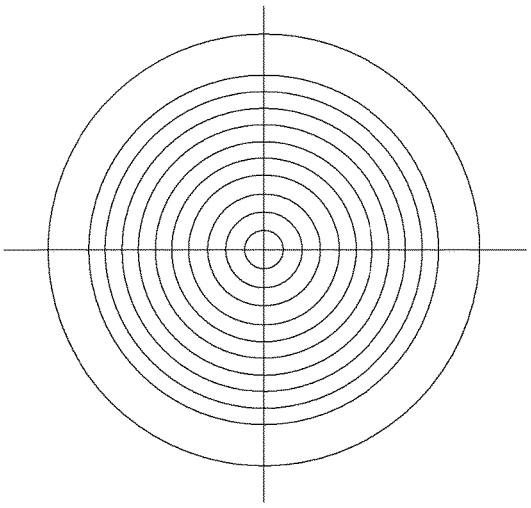
FIG. 4 is a schematic diagram of the cutting marks caused by high pressure liquid according to the first preferred embodiment of the present invention.

Referring to FIG. 1 to FIG. 4 of the drawings, FIG. 1 is a schematic diagram of a hybrid tunnel boring apparatus comprising a high pressure liquid device. FIG. 2 is a zoom-in schematic diagram of Zone A of FIG. 1. FIG. 3 is a schematic diagram of a nozzle according to a first preferred embodiment of the present invention. FIG. 4 is a schematic diagram illustrating a locus of liquid ejected by the nozzle.

The high pressure liquid device is positioned on a front portion of a shield body 101 for ejecting liquid in the direction of excavation.

According to the first preferred embodiment, the high pressure liquid device comprises a liquid storage tank 1, a pumping device 2, a pressure raising device comprising a pressurized device 3, a first guiding pipeline 4, a central rotating head 5, a second guiding pipeline 6, a protective cover 7 and a plurality of nozzles 8, wherein these elements are sequentially provided along a flowing path of liquid. The first guiding pipeline 4 connects the pressurized device 3 to the central rotating head 5. The liquid storage tank 1 is arranged to store a predetermined amount of liquid, which is preferably water. The pumping device 2 is connected to the liquid storage tank 1 for pumping the liquid stored therein to the pressurized device 3. The pressurized device 3 is arranged to raise the pressure of the liquid which is then delivered to the central rotating head 5 through the first guiding pipeline 4. The central rotating head 5 then delivers the liquid with relatively higher pressure to the nozzles 8 through the second guiding pipeline 6. The nozzles 8 form a nozzle array on a cutter disc 103, wherein liquid from the nozzle array is arranged to be ejected to the ground or soil surface which is to be excavated.

The central rotating head 5 connects to the first guiding pipeline 4 and the second guiding pipeline 6. The second guiding pipeline 6 may be further divided into a plurality of branch pipelines.

Each of the nozzles 8 forming the nozzle array comprises a nozzle body and a nozzle head 81. The nozzle head 81 has a hole 83 formed thereon, wherein the pressurized liquid delivered to the nozzle 8 is arranged to be ejected out of the nozzle 8 through the hole 83. A diameter of the hole 83 is smaller than an internal diameter of the nozzle body. As shown in FIG. 3 of the drawings, each of the nozzles 8 has a nozzle end portion 82 connected to the second guiding pipeline 6. The nozzle end portion 82 is formed at a position opposite to the nozzle head 81. Each of the nozzles 8 are provided on the same plane, and is mounted on the cutting disc 103 at a position between two adjacent cutters 102 (see FIG. 7). As such, the nozzles 8 may be distributed to form a plurality of concentric circles on the cutting disc 103. When the hybrid tunnel boring apparatus is operating, the cutters 102, the cutting disc 103 and the nozzles 8 may rotate simultaneously about a common axis.

In order to increase the velocity of the liquid ejected from the nozzles 8, the diameter of the holes 83 should be very small, preferably in the range between 5 mm and 20 mm.

In this first preferred embodiment of the present invention, the protective cover 7 is provided on the second guiding pipeline 6 and the connecting portion between the second guiding pipeline 6 and the nozzles 8. The protective cover 7 is used to protect and cover the second guiding pipeline 6, and a connecting portion between the second guiding pipeline 6 and the nozzles 8 for preventing them from being damaged by excavated material.

FIG. 4 illustrates a schematic diagram of a cutting path or locus of the cutting disc. Since the nozzle array and the cutting disc 103 are arranged to rotate simultaneously, the high pressure liquid will leave cutting marks or pre-cut slots on the ground surface which correspond to the distribution pattern of the nozzles 8 formed on the cutting disc 103. In other words, the ground surface which is to be excavated will have cutting marks which resemble many concentric circles. Since the liquid is highly pressurized, when the liquid comes into contact with the ground surface which is to be excavated, the result is that the pressurized liquid will eventually form cutting slots on the ground surface which is to be excavated. These cutting slots cause stress concentration when the cutters 102 of the cutting disc 103 come into contact with the cutting slots. When the excavation process is being operated, the cutting slots serve as a means to allow the ground surface to be more easily bored and cut by the cutters 102 formed on the cutting disc 103.

Figure 5:
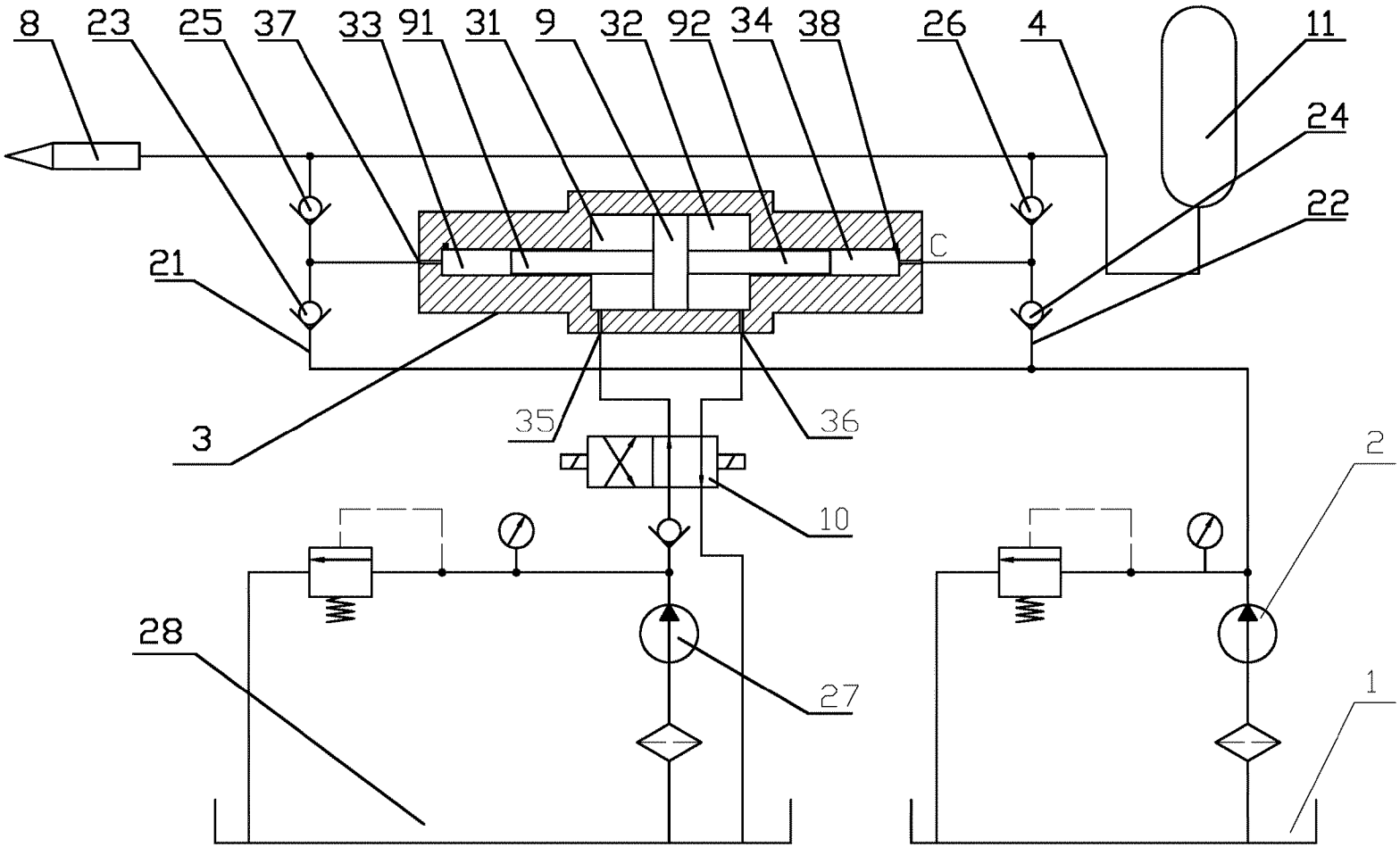
FIG. 5 is a schematic diagram illustrating the working principles of the pressurized device of the hybrid tunnel boring apparatus according to the first preferred embodiment of the present invention.

Referring to FIG. 5 of the drawings, it illustrates the working principles of the pressurized device 3.

The pressurized device 3 essentially employs piston-cylinder mechanism and is connected to the pumping device 2. The pressurized device 3 comprises a main piston 9 which divides an internal space of a cylinder into a first piston chamber 31 and a second piston chamber 32, a first piston column 91 and a second piston column 92 extended from two sides of the main piston 9 into the first piston chamber 31 and the second piston chamber 32 respectively. The cylinder further has a first column chamber 33 and a second column chamber 34 extended from the first piston chamber 31 and the second piston chamber 32 respectively, wherein the first piston column 91 is partially and movably and reciprocally received in the first column chamber 33, while the second piston column 92 is partially and movably and reciprocally received in the second column chamber 34. Thus, the first piston column 91 separates the first piston chamber 31 and the first column chamber 33. The second piston column 92 separates the second piston chamber 32 and the second column chamber 34. The main piston 91, the first piston column 91 and the second piston column 92 may form an integral structure.

The first piston chamber 31 has a first passage opening 35. The second piston chamber 32 has a second passage opening 36. The first passage opening 35 and the second passage opening 36 are both connected to a control valve 10, which is arranged to control a direction of liquid flow into or out from the first piston chamber 31 and the second piston chamber 32. The first column chamber 33 has a third passage opening 37. The second column chamber 34 has a fourth passage opening 38. The third passage opening 37 and the fourth passage opening 38 are for allowing passage of water into or out from the first column chamber 33 and the second column chamber 34 respectively.

The control valve 10 is connected between a liquid pump 27 and the pressurized device 3. The control valve 10 may be embodied as a solenoid valve, or pneumatically controlled or liquid-driven valve. The liquid pump 27 is connected to the control valve 10 through at least one connecting pipe.

The pumping device 2 is connected to the third passage opening 37 through a first pumping pipeline 21. The first pumping pipeline 21 is connected to first unidirectional valve 23 in series, in such a manner that the first unidirectional valve 23 is configured to allow liquid to flow from the pumping device 2 to the third passage opening 37 but not vice versa. On the other hand, the pumping device 2 is also connected to the fourth passage opening 38 through a second pumping pipeline 22. The second pumping pipeline 22 is connected to a second unidirectional valve 24 in series, in such a manner that the second unidirectional valve 24 is configured to allow liquid to flow from the pumping device 2 to the fourth passage opening 38, but not vice versa. Furthermore, the third passage opening 37 is connected to the first guiding pipeline 4 through a third unidirectional valve 25, which is configured to allow liquid flowing from the third passage opening 37 to the first guiding pipeline, but not vice versa. The fourth passage opening 38 is connected to the first guiding pipeline 4 through a fourth unidirectional valve 26, which is configured to allow liquid flowing from the fourth passage opening 38 to the first guiding pipeline 4, but not vice versa.

When the control valve 10 is in the operating position, that is, the control valve 10 is switched to the right as indicated in FIG. 5, the liquid pump 27 is connected to the first passage opening 35, and the second passage opening 36 is connected to an oil storage tank 28. The liquid pump 27 is then arranged to pump the oil contained in the oil storage tank 28 to the pressurized device 3 so as to provide a predetermined amount of pressure for driving the main piston 9, the first piston column 91 and the second piston column 92 to move in the cylinder. When the piston 9 moves in the cylinder, it alters the pressure developed in the first column chamber 33 and the second column chamber 34.

When the control valve 10 is switched to the right, oil stored in the oil storage tank 28 is delivered to the first piston chamber 31 through the liquid pump 27, the control valve 10, the pressurized device 3 and the first passage opening 35. The piston 9 and the second piston column 92 is driven to move to the right so as to develop a high pressure in the second column chamber 34. At the same time, the liquid stored in the second column chamber 34 is force to be guided to flow to the nozzles 8 through the fourth passage opening 38, the fourth unidirectional valve 26, and the first guiding pipeline 4. The liquid reaching the nozzles 8 are then arranged to be ejected to reach the ground surface which is to be excavated. The second unidirectional valve 24 is closed.

When the second piston column 92 and the piston 9 moves to the right, a negative pressure will be developed in the first column chamber 33. The pumping device 2 is arranged to pump the liquid stored in the liquid storage tank 1 to the first column chamber 33 through the first unidirectional valve 23, the pressurized device 3, and the third passage opening 37.

When the second piston column 92 is moved to the rightmost position, the control valve 10 will be switched to the left. Oil contained in the oil storage tank 28 is then pumped to the second piston chamber 32 through the control valve 10, the pressurized device 3, and the second passage opening 36 for pushing the first piston column 91 to move to the left. At the same time, a high liquid pressure is developed in the first column chamber 33. This high pressure drives the liquid in the first column chamber 33 to reach the nozzles 8 through the pressurized device 3, the third passage opening 37, the third unidirectional valve 25, and the first guiding pipeline 4. The water is then ejected by the nozzles 8 for assisting excavation of the ground surface. The first unidirectional valve 23 is now closed for preventing water from entering other components of the hybrid-type tunnel boring apparatus of the present invention.

When the first piston column 91 and the piston 9 move to the left, a negative pressure will be developed in the second column chamber 34. The pumping device 2 is then arranged to pump the liquid stored in the liquid storage tank 1 to the second column chamber 34 through the second unidirectional valve 24 and the second passage opening 38 for use in another working cycle.

According to the first preferred embodiment of the present invention, the hybrid-type tunnel boring apparatus further comprises an energy storage device 11 provided in the first guiding pipeline 4 for stabilizing the pressure of the liquid ejecting from the nozzles 8. The energy storage device 11 minimizes the effect of pressure impulse caused the first piston column 91 and the second piston column 92 when they change in moving direction.

Suppose an effective cross section area of the piston 9 is S1, and an effective cross sectional area of the first piston column 91 and the second piston column is S2, the liquid pressure at the first passage opening 35 and the second passage opening 36 is P1, the pressure of the liquid ejected from the nozzles 8 is P2, then the pressure ratio K=P2/P1=S1/S2. That is, the greater the difference between S1 and S2, the greater the pressure ratio. In order to maximize the pressure ratio, pressurized device with high output pressure (such as hundreds of MPa) may be utilized. Furthermore, a plurality of pressurized devices 3 which are connected in parallel may also be utilized.

Although water is used as a working liquid, one skilled in the art would understand that a small quantity of soluble emulsified oil may be added to the water to increase its viscosity or tightness so as to minimize leakage of water in the hybrid-type tunnel boring apparatus.

Embodiment 2

Figure 6:
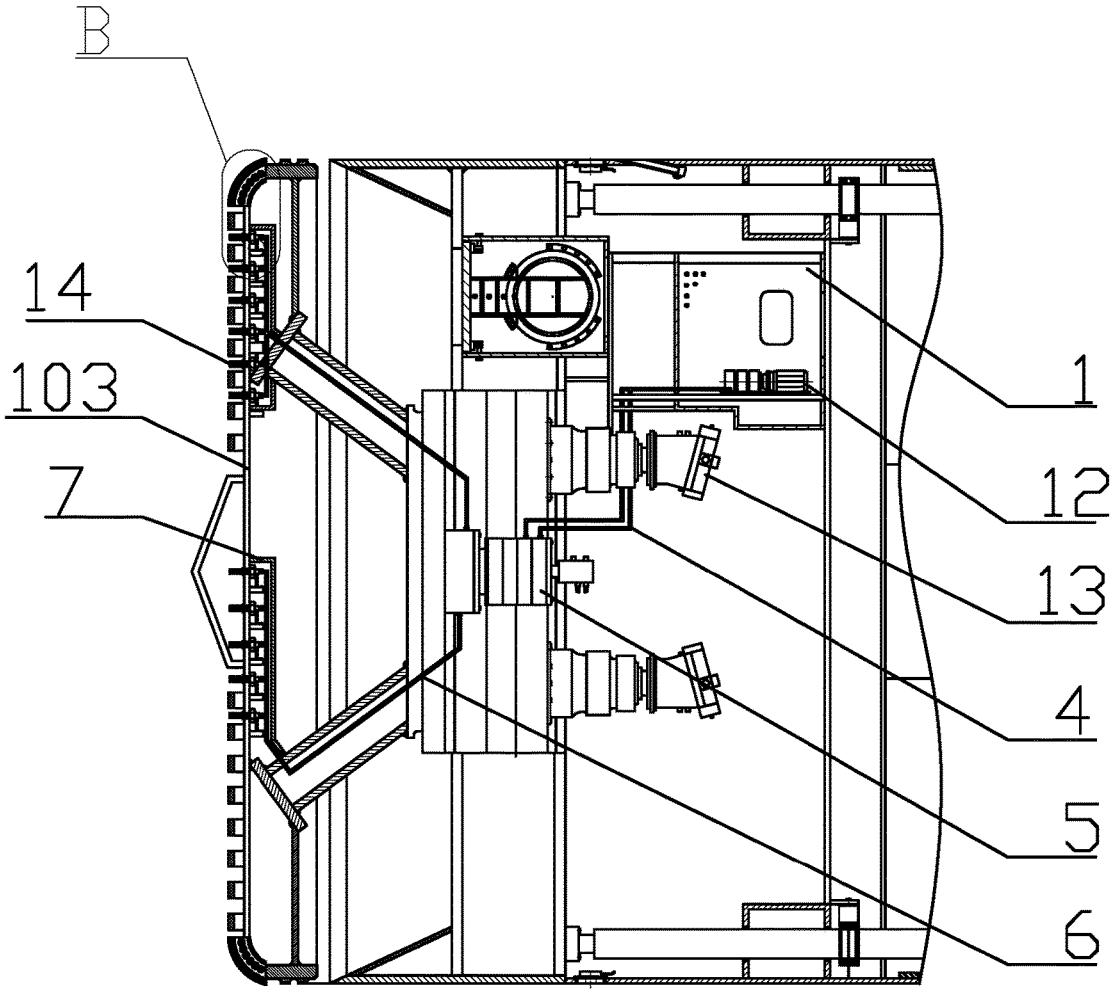
FIG. 6 is a schematic diagram illustrating a hybrid nozzle assembly of the hybrid type tunnel boring device according to a second preferred embodiment of the present invention.
Figure 7:
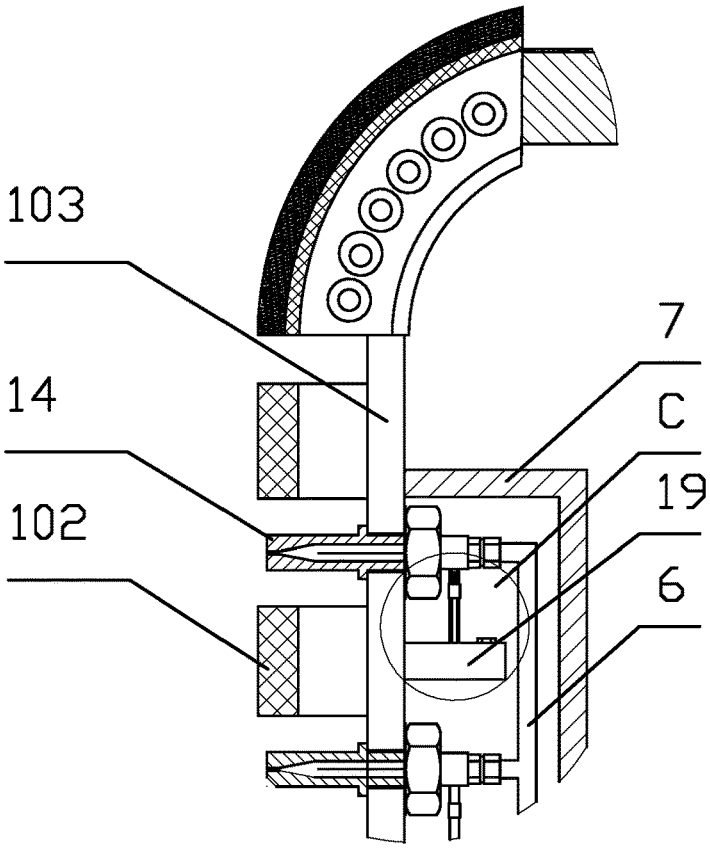
FIG. 7 is a zoom in schematic diagram of zone B of FIG. 6, illustrating the structure of a grinder supplying device.
Figure 8:
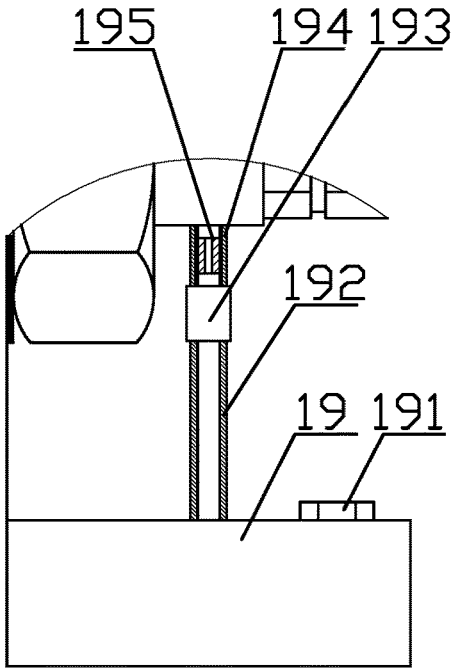
FIG. 8 is a zoom in schematic diagram of zone C of FIG. 7, illustrating the structure of a flow regulator.
Figure 9:
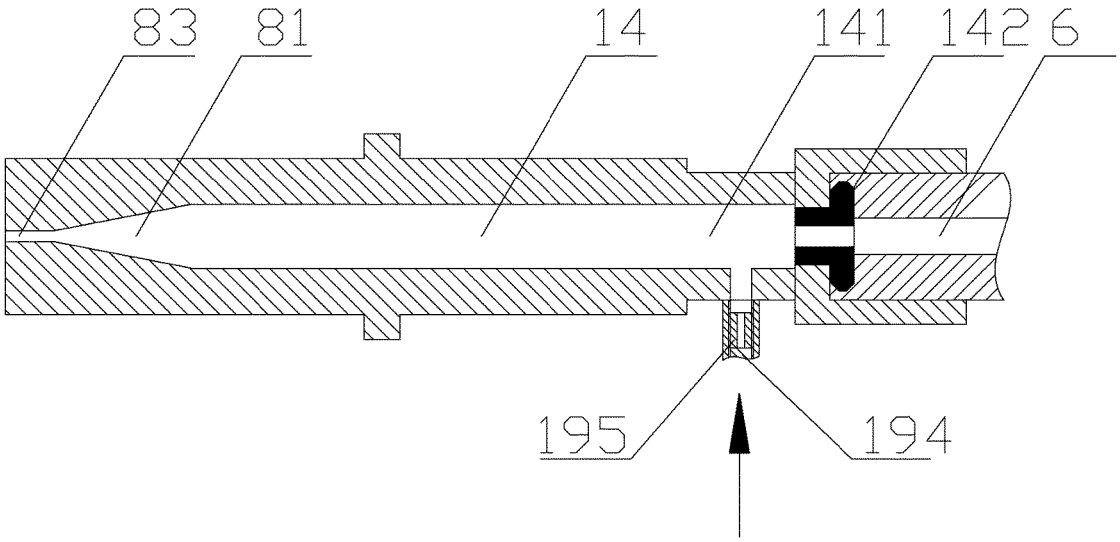
FIG. 9 is a schematic diagram of the nozzle according to the second preferred embodiment of the present invention.

FIG. 6 is a schematic diagram of a hybrid-type tunnel boring apparatus according to a second preferred embodiment of the present invention. FIG. 7 is a zoom-in schematic diagram of Zone B of FIG. 6, illustrating the structure of a grinder supplying device. FIG. 8 is a zoom-in schematic diagram of Zone C of FIG. 7, illustrating that the grinder supplying device comprises a grinder supplying pipeline and a grinder control device. FIG. 9 is a schematic diagram of the nozzle according to the second preferred embodiment of the present invention.

The second preferred embodiment utilizes a driving unit to drive a high pressure piston pump and a nozzles to eject a high pressure liquid for assisting excavation of a ground surface. The second preferred embodiment of the present invention involves the use of a hybrid-type nozzle assembly. The ejected liquid is a mixture of water and a predetermined amount of grinding agent.

Referring to FIG. 6 of the drawings, the hybrid-type tunnel boring apparatus according to the second preferred embodiment of the present invention comprises a liquid storage tank 1, a driving unit 12, a high pressure piston pump 13, a first guiding pipeline 4, a central rotating head 5, a second guiding pipeline 6, a hybrid nozzle assembly 14, a protective cover 7 and a grinder supplying device. All of these components are sequentially installed along a liquid flowing path. The first guiding pipeline 4 connects the high pressure piston pump 13 and the central rotating head 5. The hybrid nozzle assembly 14 is provided between two adjacent cutters 102. The hybrid nozzle assembly 14 is connected to the grinder supplying device.

According to the second preferred embodiment of the present invention, the high pressure piston pump 13 is arranged to be directly actuated by a driving unit, such as KAMAT series from Germany. This kind of high pressure piston pump 13 has simple installation procedures, yet it has a relatively lower pressure ratio by approximately 10% to 25% when compared with the first preferred embodiment described above. The overall working principles of the hybrid-type tunnel boring apparatus is similar to that of the first preferred embodiment.

In order to ensure that the liquid ejected from the hybrid nozzle assembly 14 have adequate pressure or momentum, a predetermined amount of powder of hard materials may be added to the liquid such as water to act as the grinding agent. The grinding agent may be garnet powder or quartz sand. In order to prevent the hybrid nozzle assembly 14 from being damaged or eroded by the grinding agent, the hybrid nozzle assembly 14 may be made or configured from hard metallic material or gemstones.

Referring to FIG. 9 of the drawings, the hybrid nozzle assembly 14 comprises a mixing chamber 141 and a regulating opening 142 communicated with the mixing chamber 141. The regulating opening 142 also communicates with the second guiding pipeline 6. The regulating opening 142 is positioned an end portion of the hybrid nozzle assembly 14 to connect to the second guiding pipeline 6. A diameter of the regulating opening 142 is smaller than that of an internal diameter of the mixing chamber 141. Liquid from the second guiding pipeline 6 is arranged to flow into the mixing chamber 141 through the regulating opening 142 to mix with the grinding agent. The resulting liquid which is mixed with the grinding agent is then arranged to eject to the ground surface to be excavated through the holes 83 provided at the corresponding nozzle heads 81.

Referring to FIG. 7 to FIG. 9 of the drawings, the grinder supplying device comprises a grinder storage tank 19 connected to the hybrid nozzle assembly 14 through a grinder connecting pipeline. The grinder storage tank 19 further has a ventilating hole 191 communicating with ambient air. The grinder connecting pipeline comprises an upper portion 194 and a lower portion 192 connected to the upper portion 194 through a nut bolt 193. The main portion of the hybrid nozzle assembly 14 has a communicating opening communicating with the mixing chamber 141. The communicating opening also connects with the grinder connecting pipeline. One skilled in the art may appreciate that the above configuration is merely exemplary. For example, the upper portion 194 and the main portion of the hybrid nozzle assembly 14 may form an integral body. The main portion may also connect with the grinder storage tank 19 by other means.

The high pressure piston pump 13 is directly driven by a driving unit 12 to pump the liquid stored in the liquid storage tank 1 to the nozzles through the first guiding pipeline 4 and the central rotating head 5. Liquid with high pressure is arranged to be ejected through the regulating opening 142. Since a diameter of the regulating opening 142 is smaller than an internal diameter of the mixing chamber and a diameter of the second guiding pipeline 6, a negative pressure will be developed in the mixing chamber 141 during the liquid ejection process. Since the grinder storage tank 19 communicates with ambient air through the ventilating hole 191, the grinding agent may be sucked to enter the mixing chamber 141 through the grinder connecting pipeline to mix with the water coming from the liquid storage tank 1. The resulting mixture is then ejected to the ground surface at a very high speed through the hybrid nozzle assembly 14 for assisting excavation. The hybrid nozzle assembly 14 further comprises a flow regulator 195 replaceably provided between the mixing chamber 141 and the grinder storage tank 19, and connected to the grinder connecting pipeline. The amount of the grinding agent may be adjusted by replacing the flow regulator 195 with differing flow passage diameters.

From the above descriptions, one skilled in the art may appreciate that the various features described above may form a many combinations within the spirit of the present invention. For example, the grinding arrangement disclosed in the second preferred embodiment may also be used in conjunction with the nozzles 8 disclosed in the first preferred embodiment. Similarly, the protective cover 7 disclosed in the first preferred embodiment may also be used to protect the hybrid nozzle assembly 14 and the various connecting pipelines disclosed in the second preferred embodiment.

When compared with conventional tunnel boring apparatuss, the present invention has wider applicability to different grounds types. When the present invention is used in soft ground, a user of the present invention may utilize both the cutters and the high pressure liquid for excavation. This prevents the cutting disc from being accidentally stuck. This also prevents excavated material from being abundantly residing on the cutting disc. When the present invention is used on hard rock, the high pressure liquid causes cutting marks on the ground surface. This allows the cutters of the present invention to easily cut the ground surface. Furthermore, conventional tools for excavating soft grounds such as cutting bits and scrapers may be utilized for excavating hard rock with the aid of the high pressure liquid and the formation of the cutting marks. These arrangements reduce the need to have hard rock cutting tools and the corresponding replacement time and costs and thus increases the overall efficiency of tunnel boring.

Furthermore, the high pressure liquid may actually have cooling and cleaning effect to the cutters 102 and the cutting disc 103 so as to increase the general lifespan of the cutters 102 and the cutting disc 103. In addition, ejecting liquid in tunnels may also help in removing dusts and decreasing temperature in the tunnels.

One skilled in the art will understand that the embodiments of the present invention as shown in the drawings and described above are exemplary only and should not be limited as such. The embodiments have been shown and described for the purposes of illustrating the functional and structural principles of the present invention and is subject to change without departure from such principles.

What is claimed is:

1. A tunnel boring apparatus, comprising a shield body (101) and a cutting disc (103) provided at a front portion of the shield body (101), characterized in that said tunnel boring apparatus further comprises a high pressure liquid device, which comprises:

a liquid storage tank (1) for storing a predetermined amount of liquid;

a pressure raising device for increasing a pressure of said liquid, said pressure raising device connecting to said liquid storage tank (1), and connecting to a central rotating head (5) through a first guiding pipeline (4); and a plurality of nozzles (8) provided on said cutting disc (103), said nozzles connecting to said central rotating head (5) through a second guiding pipeline (6), wherein said pressure raising device comprises a driving unit (12), and a high pressure piston pump (13) connected to said driving unit (12), an inlet of said high pressure piston pump (13) being connected to said liquid storage tank (1), an outlet of said high pressure piston pump (13) being connected to said first guiding pipeline (4), wherein said tunnel boring apparatus further comprises a hybrid nozzle assembly (14) which comprises a mixing chamber (141) and a regulating opening (142) communicated with said mixing chamber (141), said regulating opening (142) communicating with said second guiding pipeline (6), a diameter of said regulating opening (142) being smaller than that of an internal diameter of said mixing chamber (141); and a grinder supplying device comprising a grinder storage tank (19) connected to said mixing chamber (141) of said hybrid nozzle assembly (14), said grinder storage tank (19) having a ventilating hole (191) communicating with ambient air.

2. The tunnel boring apparatus, as recited in claim 1, further comprising a flow regulator (195) replaceably provided between said mixing chamber (141) and said grinder storage tank (19), and connected to a grinder connecting pipeline.

3. A tunnel boring apparatus, comprising a shield body (101) and a cutting disc (103) provided at a front portion of the shield body (101), characterized in that said tunnel boring apparatus comprises a high pressure liquid device, which comprises:

a liquid storage tank (1) for storing a predetermined amount of liquid;

a pressure raising device for increasing a pressure of said liquid, said pressure raising device connecting to said liquid storage tank (1), and connecting to a central rotating head (5) through a first guiding pipeline (4); and a plurality of nozzles (8) provided on said cutting disc (103), said nozzles connecting to said central rotating head (5) through a second guiding pipeline (6), wherein each of said nozzles (8) is provided on said cutting disc (103) at a position between two adjacent cutters (102), wherein said pressure raising device comprises a driving unit (12), and a high pressure piston pump (13) connected to said driving unit (12), an inlet of said high pressure piston pump (13) being connected to said liquid storage tank (1), an outlet of said high pressure piston pump (13) being connected to said first guiding pipeline (4), wherein said tunnel boring apparatus further comprises a hybrid nozzle assembly (14) which comprises a mixing chamber (141) and a regulating opening (142) communicated with said mixing chamber (141), said regulating opening (142) communicating with said second guiding pipeline (6), a diameter of said regulating opening (142) being smaller than that of an internal diameter of said mixing chamber (141); and a grinder supplying device comprising a grinder storage tank (19) connected to said mixing chamber (141) of said hybrid nozzle assembly (14), said grinder storage tank (19) having a ventilating hole (191) communicating with ambient air.

4. The tunnel boring apparatus, as recited in claim 3, further comprising a flow regulator (195) replaceably provided between said mixing chamber (141) and said grinder storage tank (19), and connected to a grinder connecting pipeline.

5. A tunnel boring apparatus, comprising a shield body (101) and a cutting disc (103) provided at a front portion of the shield body (101), characterized in that said tunnel boring apparatus comprises a high pressure liquid device, which comprises:

a liquid storage tank (1) for storing a predetermined amount of liquid;

a pressure raising device for increasing a pressure of said liquid, said pressure raising device connecting to said liquid storage tank (1), and connecting to a central rotating head (5) through a first guiding pipeline (4); and a plurality of nozzles (8) provided on said cutting disc (103), said nozzles connecting to said central rotating head (5) through a second guiding pipeline (6), wherein said pressure raising device comprises a driving unit (12), and a high pressure piston pump (13) connected to said driving unit (12), an inlet of said high pressure piston pump (13) being connected to said liquid storage tank (1), an outlet of said high pressure piston pump (13) being connected to said first guiding pipeline (4), wherein said tunnel boring apparatus further comprises a protective cover (7) covering said second guiding pipeline (6); a connecting portion between said nozzles (8) and said second guiding pipeline (6);

a hybrid nozzle assembly (14) which comprises a mixing chamber (141) and a regulating opening (142) communicated with said mixing chamber (141), said regulating opening (142) communicating with said second guiding pipeline (6), a diameter of said regulating opening (142) being smaller than that of an internal diameter of said mixing chamber (141);

a grinder supplying device comprising a grinder storage tank (19) connected to said mixing chamber (141) of said hybrid nozzle assembly (14), said grinder storage tank (19) having a ventilating hole (191) communicating with ambient air; and a flow regulator (195) replaceably provided between said mixing chamber (141) and said grinder storage tank (19), and connected to a grinder connecting pipeline.

* * * * *